US005151157A

United States Patent [19]

le Gauyer

[11] Patent Number: 5,151,157

[45] Date of Patent: Sep. 29, 1992

[54] HEAT EXCHANGER APPARATUS FOR A MOTOR VEHICLE, HAVING A MAIN HEAT EXCHANGER COMPRISING A WATER BOX CONTAINING A SECONDARY HEAT EXCHANGER

[75] Inventor: Philippe le Gauyer, Paris, France

[73] Assignee: Valeo, Le Mesnil-Saint-Denis, France

[21] Appl. No.: 738,675

[22] Filed: Jul. 31, 1991

[30] Foreign Application Priority Data

Jul. 31, 1990 [FR] France ..... 90 09767

[51] Int. Cl.[5] ..... F28F 9/02

[52] U.S. Cl. ..... 165/140; 165/76; 165/916; 285/382.4

[58] Field of Search ..... 165/76, 140, 916, 141, 165/157; 285/222, 382.4; 29/512

[56] References Cited

U.S. PATENT DOCUMENTS 2,269,895 1/1942 Foster et al. ..... 285/382.4 X
2,566,502 9/1951 Smith ..... 285/382.4 X
3,216,492 11/1965 Weaver ..... 165/157 X
4,227,570 10/1980 Crews ..... 165/67
4,538,679 9/1985 Hoskins et al. ..... 165/178
4,553,586 11/1985 Lardner ..... 165/76

FOREIGN PATENT DOCUMENTS 0196257 1/1986 European Pat. Off. .
2549593 1/1985 France ..... 165/916

*Primary Examiner*—Allen J. Flanigan
*Attorney, Agent, or Firm*—Longacre & White

[57] ABSTRACT

In a heat exchanger apparatus comprising a main heat exchanger having a water box with a secondary heat exchanger inside the water box, the secondary heat exchanger includes two coupling tubes passing sealingly through a wall of the water box. The secondary heat exchanger is secured to the water box by means of these coupling tubes. Each coupling tube is carried on the secondary heat exchanger by being introduced into an access hole in the wall, and being secured in a base ring of the secondary heat exchanger. Each coupling tube has a deformable terminal portion which is upset so as to expand it radially in a hole formed in the base ring.

9 Claims, 1 Drawing Sheet

HEAT EXCHANGER APPARATUS FOR A MOTOR VEHICLE, HAVING A MAIN HEAT EXCHANGER COMPRISING A WATER BOX CONTAINING A SECONDARY HEAT EXCHANGER

FIELD OF THE INVENTION

This invention relates to heat exchanger apparatus, in particular, though not exclusively, for use in a motor vehicle, of the kind comprising a main heat exchanger having a water box, with a secondary heat exchanger contained in the water box.

BACKGROUND OF THE INVENTION

In known apparatuses of this kind, a first fluid flows through the main heat exchanger, while a second fluid, which is cooled by the first fluid, flows through the secondary heat exchanger. In the application of such an apparatus to motor vehicles, the first fluid is the cooling liquid for the engine of the vehicle, while the second fluid may for example be a lubricating oil for the engine, or gearbox oil, or oil for a torque converter. Thus the engine coolant liquid not only fulfils its usual function of cooling the engine, but also an additional function whereby it cools a further fluid related to the operation of the vehicle.

In known arrangements of this kind, the secondary heat exchanger is introduced through an open side of the water box, and the latter is then joined to the body or the tube bundle of the main heat exchanger. The secondary heat exchanger has two coupling tubes, which serve respectively as input and output tubes for the second fluid, and which extend sealingly through two orifices formed in a wall of the water box. This arrangement also secures and retains the secondary heat exchanger within the water box.

The specification of French patent application No. 83 12200, published under the number FR-2 549 593-A, describes an apparatus of the kind described above, in which each of the two coupling tubes is fitted on the secondary heat exchanger by introducing it into one of the holes in the side wall of the water box, and is then secured to a base member of the secondary heat exchanger. In this known arrangement, each coupling tube includes a threaded portion which is screwed into a threaded bore of the base member. The latter is engaged against the inner face of the wall of the water box, with two seals being interposed between them. These seals are compressed under the action of the gripping force exerted by a nut which is screwed on to a further threaded portion of the coupling tube, and which bears in abutting engagement against the outer face of the water box side wall.

In this known arrangement, the threaded portion of the coupling tube must extend partly into the interior of the secondary heat exchanger, which must then have a width sufficient to accommodate this threaded portion. This leads to the use of a secondary heat exchanger which is somewhat large, and this in turn increases the size of the water box. In addition, since the threaded portion projects into the interior of the secondary heat exchanger, this disturbs the flow of fluid circulating in the latter. This known arrangement is also somewhat complicated to manufacture, in particular since it necessitates two thread forming operations for each of the two coupling tubes.

DISCUSSION OF THE INVENTION

A main object of the invention is to overcome the disadvantages mentioned above.

To this end, it provides a water box for a main heat exchanger, containing a secondary heat exchanger having two coupling tubes which pass sealingly through a wall of the water box, and by means of which the secondary heat exchanger is secured in the water box, with each of the coupling tubes being fitted on to the secondary heat exchanger by being introduced into a hole in the wall of the water box and secured in a base member of the secondary heat exchanger.

In accordance with one of the essential features of the invention, each coupling tube includes a terminal portion which is adapted to be expanded radially in a hole formed in the base member. Thus, the coupling tube can be fitted in a very simple manner to the secondary heat exchanger, since it is merely necessary to introduce the terminal portion of the coupling tube from outside the water box, in succession through the hole in the wall of the water box and into the hole in the base member, after which the radial expansion of the terminal portion of the coupling tube is effected in the latter hole, using an appropriate tool.

In accordance with a further feature of the invention, the coupling tube has an intermediate portion with a collar adapted to bear in abutting engagement against the said wall of the water box around the access hole in the latter, and on the outside of the water box, with the said intermediate portion being extended on one side by the deformable terminal portion and on the other side by a coupling sleeve. With this arrangement, during the upsetting or riveting operation, the wall of the water box becomes gripped against the base members under the combined action of the collar on the one hand and the deformed terminal portions of the coupling tubes on the other.

Preferably, the deformable terminal portion is bounded by an initially cylindrical outer surface, and by an inner surface which is initially frusto conical with its diameter decreasing towards the free end of the terminal portion.

Preferably, the initially cylindrical outer surface of the terminal portion is joined, on the side thereof remote from its free end, to a frusto conical outer surface, the diameter of which increases towards the said collar, while the initially frusto conical internal surface of the terminal portion is joined on the side thereof remote from its free end to a cylindrical internal surface of an intermediate passage which extends partly within the coupling tube. With this arrangement, an annular junction zone of reduced thickness is formed between the intermediate portion and the terminal portion of the coupling tube, which facilitates its radial expansion during the upsetting operation.

The terminal portion is preferably adapted to be expanded radially in such a way that, after the upsetting operation, the initially frusto conical inner surface of the terminal portion becomes a substantially cylindrical extension of the cylindrical internal surface of the intermediate passage.

An apparatus in a preferred form according to the invention will now be described, by way of example only and with reference to the accompanying drawings.

DESCRIPTION OF A PREFERRED EMBODIMENT OF THE INVENTION

Figure 1:
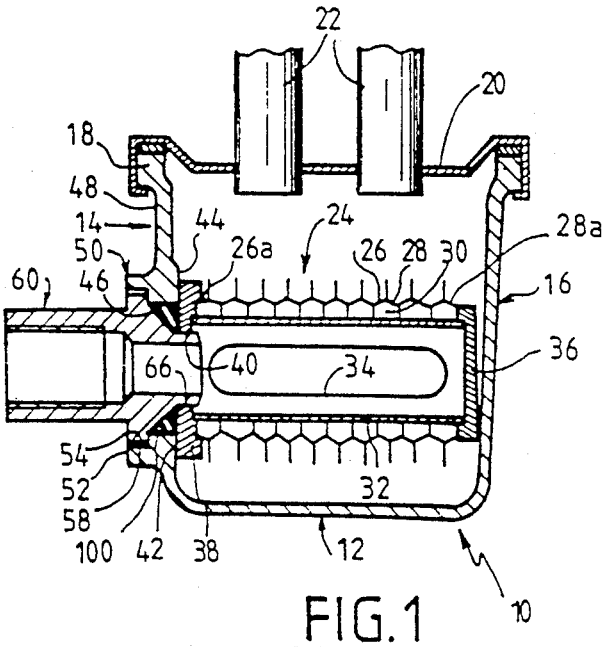
FIG. 1 is a view in cross section of a water box of a primary heat exchanger containing a secondary heat exchanger, in which the cross section is taken on a plane passing through the axis of one of the two coupling tubes.

Reference is first made to FIG. 1, which shows a water box 10 of a main heat exchanger, for example the water box of a cooling radiator of an internal combustion engine. The water box includes a base wall 12, from which there depend side walls including two walls 14 and 16. The side walls together define an open side of the water box which is bounded by a generally rectangular edge 18. The water box 10 is arranged to be assembled through its edge 18 on to a collecting plate 20, into which flow tubes 22 are open. The flow tubes 22 form the tube bundle of the main heat exchanger, and in this example the engine cooling liquid of the vehicle passes through these tubes.

A secondary heat exchanger 24 is arranged inside the water box 10. The secondary heat exchanger 24 is adapted to enable a fluid different from that circulating in the flow tubes 22 to be cooled. For example this fluid flowing in the secondary heat exchanger 24 may be a gearbox lubricating oil.

In the example shown, the secondary heat exchanger 24 comprises a stack of half plates 26 and 28, which are brazed together and which define at their ends elementary collecting chambers 30, the walls of which are perforated so that they will communicate firstly between each other and secondly with two distributor tubes 32 which act as stretchers. Only one of the tubes 32 is visible in the drawing. Each tube 32 has an aperture 34 extending over substantially its whole length and serving to enable the fluid to pass from one chamber to the other. Each tube 32 is closed at one end by a cover plate 36, to which it is brazed, and which is also brazed to the endmost half plate 28*a*. Each tube 32 is closed at its other end by a base member 38 in the form of a ring, to which it is brazed. The base rings 38 are also brazed on to the endmost half plate 26*a*. Each base ring 38 has a cylindrical hole 40 which is coaxial with the corresponding tube 32, with the diameter of the hole 40 being smaller than the internal diameter of the distributor tube 32.

Figure 2:
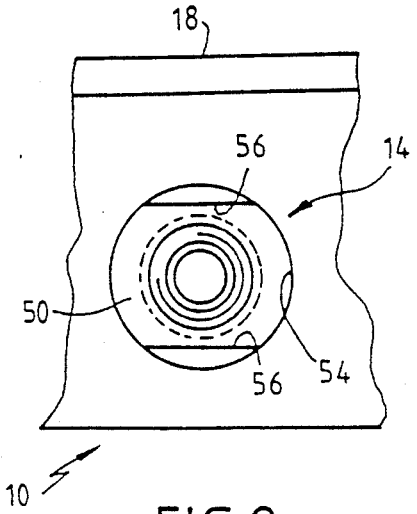
FIG. 2 is a side view showing the wall of the water box of FIG. 1 and the access hole for one coupling tube.

Each base ring 38 also has an annular face 42 which is adapted to come into abutting engagement against an internal face 44 of the water box side wall 14. The wall 14 has two access holes 46, only one of which can be seen in the drawing. The access holes 46 are arranged at exactly the same spacing between their axes as the two holes 40 of the secondary heat exchanger 24. The internal diameter of the access holes 46 is greater than the internal diameter of the holes 40. The water box side wall 14 has an outer face 48, which is formed with a projecting crown 50 that extends coaxially with the access hole 46. The crown 50 has a generally annular outer face 52 which is joined to a generally cylindrical inner surface 54, and which is provided with two lips 56 (FIG. 2) which are parallel to each other. The cylindrical surface 54 and its two lips 56 are joined to the hole 46 through a shoulder 58 which is generally annular in shape.

The apparatus shown in FIG. 1 also includes two coupling tubes 60, only one of which can be seen in the drawing, extending through the thickness of the wall 14. The secondary heat exchanger 24 is secured within the water box 10 by means of these coupling tubes, each of which is fitted on the heat exchanger 24 by being introduced successively through the holes 46 in the wall 14 and then into a respective one of the holes 40 in the base ring 38, to which it is then secured by upsetting as will be described below.

Each coupling tube 60 (see FIG. 3) includes an intermediate portion 62 having a collar 64. This intermediate portion 62 is extended on one side by a deformable terminal portion 66 of the coupling tube, and on the other side by a coupling sleeve 68, which is also part of the coupling tube. The terminal portion 66 is bounded by an outer surface 70 and an inner surface 72. In the initial stage shown in FIG. 3, the outer surface 70 is cylindrical and the inner surface 72 is convergent towards the free end of the terminal portion 66, which has an end face 74 which in the initial state is annular. In this initial state, the diameter of the inner surface 72 thus decreases towards the end face 74.

The initially cylindrical outer surface 70 is joined on the side opposite to its free end to an external frusto conical surface 76, the diameter of which increases towards the collar 64. The initially frusto conical internal surface 72 of the terminal portion 66 is joined on the side opposite to its free end to a cylindrical internal surface 78 which defines an intermediate passage within the tube 60. The intermediate portion 62 and the terminal portion 66 are thus joined together through an annular zone 80 of reduced thickness.

The collar 64 has an annular face 82 which is joined to a generally cylindrical, peripheral surface 84 formed with two flats 86. The peripheral surface 84 is joined through an annular face 87 to a cylindrical surface 88 which constitutes the outer surface of the coupling sleeve 68. The latter is formed with an internal threaded bore 90, which is joined to the internal surface 78 through a frusto conical portion 92.

The coupling tube 60 is formed of a deformable metal such as aluminium, in such a way that the terminal portion 66 is able to be expanded radially using an appropriate tool. The presence of the zone 80 with its reduced thickness facilitates this radial expansion. Such a tool is indicated in phantom lines in FIG. 3 at 94. It comprises a bar 96 which is extended in a head 98, having a frusto conical portion 98*a*. The end of the frusto conical portion 98*a* having the smaller diameter (d) is joined to the bar 96, while its other end, having the larger diameter (D) is joined to a portion 98*b* of the head 98 having substantially the shape of a spherical skull cap.

The diameter d of the tool corresponds approximately to the internal diameter of the terminal portion 66 of the coupling tube 60 at its free end face 74, while the diameter D of the tool corresponds substantially to the internal diameter of the intermediate passage defined by the cylindrical surface 78. In the example shown, the bar 96 of the tool 94 is introduced through the free end of the terminal portion 66 in the direction indicated by the arrow F, in such a way that the head 98 then projects out of the free end of the terminal portion 66.

Figure 3:
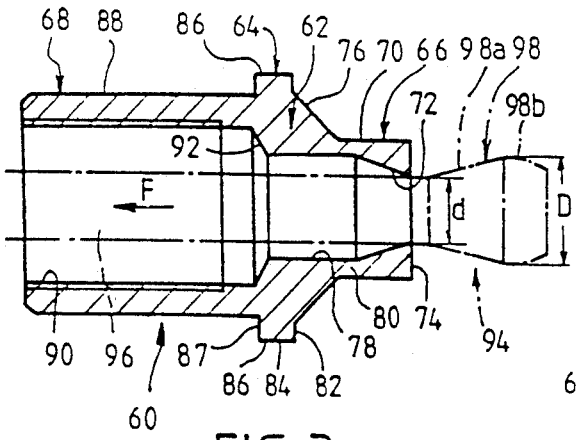
FIG. 3 is a view in axial cross section of a coupling tube before being secured in position.

The way in which the secondary heat exchanger 24 is fitted within the water box 10 and secured to it will now be described. The secondary heat exchanger 24 is first introduced through the open side of the water box 10, and it is then positioned in such a way that the holes 40 in the base rings 38 lie in axial alignment with the access holes 46 in the side wall 14. After this, the two coupling tubes 60 are introduced, either simultaneously or one after the other, with the coupling tube carrying the tool 94 as shown in FIG. 3. During introduction of the coupling tube 60, its terminal portion 66 is inserted successively through the access hole 46 in the wall 14 and then through the hole 40 in the base ring 38, until the annular face 32 of its collar 64 bears in abutting engagement against the annular face 58 of the wall 14.

An O-ring seal 100 is placed beforehand in the annular space formed between the frusto conical outer surface 76 of the intermediate portion 62, the hole 46 in the wall 14 and the abutment face 42 of the base ring 38. The collar 64 thus comes into abutting engagement in its seating, and the flats 86 of the collar cooperate with the lips 56 of the crown 52 so as to prevent the coupling tube 60 from rotating about its axis. In the abutting position thus obtained, the sealing ring 100 is compressed and ensures sealing at the interface between the wall 14, base ring 38 and coupling tube 60.

Figure 4:
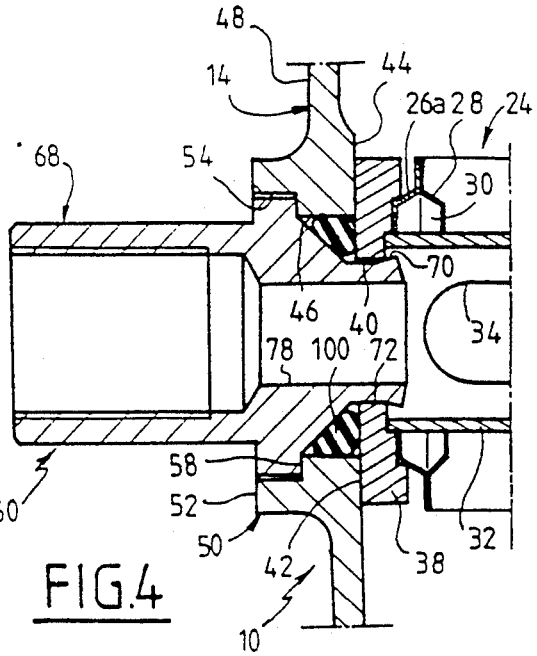
FIG. 4 is a detail view on a larger scale than FIG. 1, showing the same coupling tube asecured in position.

Once the face 42 of the base ring 38 has been engaged against the internal face 44 of the water box wall 14, a tractive force is applied on the bar 96 of the tool 94 in the direction of the arrow F. The frusto conical portion 98*a* of the head 98 thus expands the terminal portion 66 radially, so that the inner surface 72 is deformed from its initially frusto conical shape so as to become a substantially cylindrical extension of the cylindrical internal surface 78, as is shown in FIG. 4. The internal surface 70 of the terminal portion 66 is upset from its original cylindrical shape so as to be deformed outwardly, and thus secures the terminal portion 66 on to the base ring 38.

In a modification, this upsetting or riveting operation may be carried out using a different tool. For example, it is possible first to introduce the terminal portion 66 of the coupling tube 60 through the access hole 46 and the hole 40, and then to introduce a tool from the opposite end of the coupling tube, in a direction opposite to that indicated by the arrow F. In that case, it would be necessary for the head of the tool to be of a shape which was substantially different from that of the head 98, being for example in the form of an olive. The upsetting operation is then carried out during the movement in which the tool itself is introduced, and the latter is then removed by displacing it in the direction of the arrow F.

After the two coupling tubes 60 have been fitted, the water box 10 may be offered up on its open side to the collector plate 20, in a known manner.

The invention is of course not limited to the embodiment described above and shown in the drawings. In particular, instead of using a plate type secondary heat exchanger, a heat exchanger of another type, for example a cylindrical heat exchanger, may be used. Similarly, whereas in the above description only a single O-ring seal 100 has been mentioned, it is possible to provide a second sealing member between the internal face 44 and the base 42.

What is claimed is:

1. A heat exchanger apparatus comprising:

a main heat exchanger including a water box having a side wall defining an external face of said water box, said side wall having a pair of access holes formed therethrough;

a secondary heat exchanger within said main heat exchanger, said secondary heat exchanger including two coupling tubes, each of said coupling tubes extending through a respective one of said access holes, whereby said secondary heat exchanger is adapted to be secured within said water box by said coupling tubes, said secondary heat exchanger further including a base ring coaxial with each of said coupling tubes and having a hole formed therethrough; and an O-ring seal in an annular space defined between said water box, one of said coupling tubes and one of said base rings.

2. The apparatus according to claim 1, wherein each of said coupling tubes further includes an intermediate portion, a deformable terminal portion and a coupling sleeve, with the intermediate portion joining the terminal portion to the coupling sleeve, the intermediate portion including a collar adapted to engage said external face of the side wall of the water box a surrounding on of the access holes, the deformable terminal portion is adapted to be expanded radially in said hole of one of said base rings.

3. The apparatus according to claim 2, wherein the terminal portion of each of said coupling tubes is bounded by an initially cylindrical outer surface and by an initially frusto conical inner surface such that its diameter reduces towards a free end of the terminal portion.

4. The apparatus according to claim 3, wherein the terminal portion of each of said coupling tubes further has a frusto conical outer surface joining the initially cylindrical outer surface with the collar, with the diameter of the frusto conical outer surface increasing towards the collar, each of the coupling tubes having an internal intermediate passage having a cylindrical internal surface initially constituting part of the length of the passage and joined to the frusto conical inner surface of the terminal portion so that an annular junction zone of reduced thickness is defined between the intermediate portion and the terminal portion.

5. The apparatus according to claim 4, wherein the terminal portion of each of said coupling tubes is adapted to be radially expanded in such a way that, after being upset, the initially frusto conical inner surface of the terminal portion becomes a substantially cylindrical extension of the cylindrical inner surface of the intermediate passage.

6. Apparatus according to claim 5, wherein the frusto conical outer surface of the intermediate portion of each coupling tube, the corresponding access hole in the said wall of the water box, and the corresponding base ring, together define an annular space between them, the apparatus further including an O-ring seal in the said annular space.

7. The apparatus according to claim 6, wherein each of said coupling tubes is made of a deformable metal such as aluminum.

8. A heat exchanger apparatus comprising:

a main heat exchanger including a water box having a side wall defining an external face of said water box, said side wall having a pair of access holes formed therethrough;

a secondary heat exchanger within said main heat exchanger, said secondary heat exchanger including two coupling tubes, each of said coupling tubes extending through a respective one of said access holes, whereby said secondary heat exchanger is adapted to be secured within said water box by said coupling tubes, said secondary heat exchanger further including a base ring coaxial with each of said coupling tubes and having a hole formed therethrough; and wherein the side wall of the water box is formed with a profiled seating around each of said access holes each of said collars is adapted to be received in a corresponding one of said profiled seatings.

9. The apparatus according to claim 8, wherein each of said profiled seatings is formed with at least one lip, and the corresponding one of said collars is formed with at least one flat for cooperation with the at least one lip to prevent the corresponding coupling tube from rotating in the side wall of the water box.

* * * * *